United States Patent [19]

Imamichi

[11] 4,267,710

[45] May 19, 1981

[54] DOUBLE KNIT FABRIC WITH PATTERNED LOOP INTERLOCKING

[75] Inventor: Yoshio Imamichi, Tondabayashi, Japan

[73] Assignee: Mizuno Sporting Goods Co., Ltd., Osaka, Japan

[21] Appl. No.: 842,169

[22] Filed: Oct. 14, 1977

[30] Foreign Application Priority Data

Oct. 18, 1976 [JP] Japan ..... 51/140375[U]

[51] Int. Cl.[3] ..... D04B 7/04

[52] U.S. Cl. ..... 66/196

[58] Field of Search ..... 66/196, 202; 2/241

[56] References Cited

U.S. PATENT DOCUMENTS

| | | | |
|---|---|---|---|
| 391,007 | 10/1888 | Munsing | 66/202 X |
| 709,734 | 9/1902 | Bellis | 66/196 |
| 2,276,920 | 3/1942 | Bromley et al. | 66/196 |
| 2,511,685 | 6/1950 | Anderson | 66/202 X |
| 2,608,078 | 8/1952 | Anderson | 66/202 X |
| 2,741,108 | 4/1956 | Rogosin | 66/202 X |
| 2,879,654 | 3/1959 | Evans | 66/196 X |
| 2,921,456 | 1/1960 | Evans | 66/196 X |
| 2,934,923 | 5/1960 | Elwell | 66/202 X |
| 3,015,943 | 1/1962 | Loizillon | 66/202 X |
| 3,250,095 | 5/1966 | Bird | 66/202 X |
| 3,307,379 | 3/1967 | Woolley et al. | 66/196 X |
| 3,579,766 | 5/1971 | Feinberg | 66/196 X |
| 3,626,714 | 12/1971 | Blore | 66/196 |
| 3,971,234 | 7/1976 | Taylor | 66/196 |

FOREIGN PATENT DOCUMENTS

| | | | |
|---|---|---|---|
| 2612286 | 7/1976 | Fed. Rep. of Germany | 66/202 |
| 51-43473 | 4/1976 | Japan | 66/196 |
| 1030674 | 5/1966 | United Kingdom | 66/196 |

*Primary Examiner*—Werner H. Schroeder
*Assistant Examiner*—Andrew M. Falik
*Attorney, Agent, or Firm*—Bucknam and Archer

[57] ABSTRACT

A double knit fabric is described which has a front surface comprising courses of plain knit stitches formed from two synthetic fiber yarns such as polyester and rear surface comprising courses of plain knit stitches formed from a natural fiber yarn such as cotton, or a blended yarn. Each of the front and rear surface courses are interlocked with one another by the engagement of a rear surface loop with a front surface loop every several wales to form spaces between the front and rear surfaces and to form spaces in the rear surface through which portions of the front surface appear.

1 Claim, 4 Drawing Figures

DOUBLE KNIT FABRIC WITH PATTERNED LOOP INTERLOCKING

This invention relates to a knitted fabric having a specific double knit structure comprising front and rear fabric portions knitted by front yarns and rear yarn different from each other in properties such as hygroscopicity, wear resistance, dyeability, etc., respectively, the rear fabric being interlocked with the front fabric.

Synthetic yarns such as processed polyester yarns which have been developed in recent years have the characteristic properties of the synthetic fibers such as wear resistance, dyeability, etc., while the conventional natural fiber yarns such as cotton, wool, etc., have the characteristic properties such as hygroscopicity, hand touchness and the like. A double-knit structure that makes use of these yarns on the front and rear fabrics, respectively to provide all the above properties, is believed to be the most suitable and is greatly in demand.

The knitted fabric using the processed polyester yarns on the front fabric and the natural fiber yarns such as cotton as the rear fabric has good characteristics and exhibits excellent properties due to the inherent properties of these fibers as mentioned above. However, the knitted fabric of this type is still unsatisfactory with respect to its heatretaining property, air-permeability and the like.

A main object of the invention is to solve the abovementioned problem.

Another object of the invention is to improve the knit structure for the rear fabric, that is, the fabric which is brought into contact with the wearer's body.

According to the invention, the rear fabric consisting of a natural fiber yarn such as cotton has a unique net structure and is interlocked with the front fabric consisting of synthetic fiber yarns such as polyester yarns by a specific method.

These objects and advantages of this invention will become apparent from the following description taken with reference to the accompanying drawings.

Figure 1:
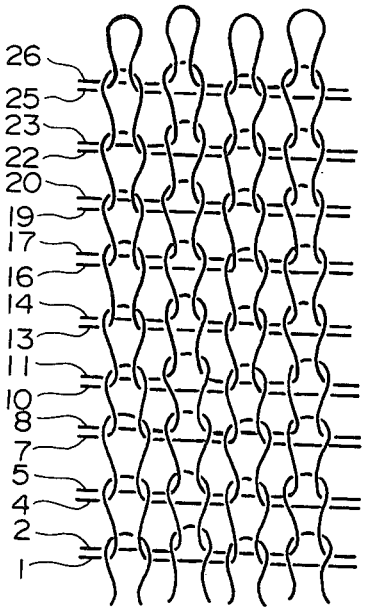
FIG. 1 is an enlarged view showing the front fabric of the knitted fabric in accordance with the present invention.
Figure 2:
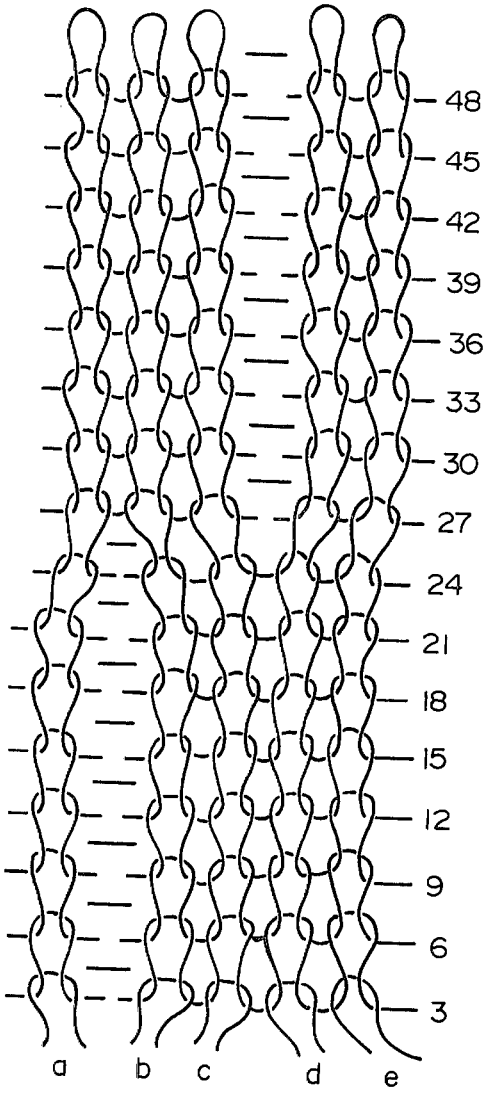
FIG. 2 is an enlarged view of the rear fabric thereof.
Figure 3:
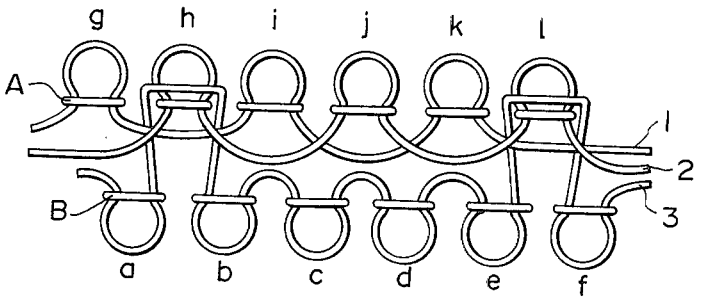
FIG. 3 is an enlarged sectional view showing the structure.

Referring to FIGS. 1 through 3 of the drawings, front yarns 1 and 2 are of synthetic fibers and a rear yarn 3 is of natural fiber such as cotton.

A course for the front fabric (A) includes loops g, i, k formed by the front yarn 1, and a course B for the rear fabric includes loops a, b, c, d, e, f formed by the rear yarn 3. The front and rear fabric portions are interconnected by interlocking the loop between wales a and b to the front loop h, and the loop between wales e and f to the front loop 1. The course A for the front fabric also includes loops h, j, l formed by the front yarn 2. Thus the front fabric and the rear fabric form a knitted fabric.

During this knitting operation, gaps are formed between wales a and b and e and f so that the rear fabric is imparted with an ordinary net structure.

Figure 4:
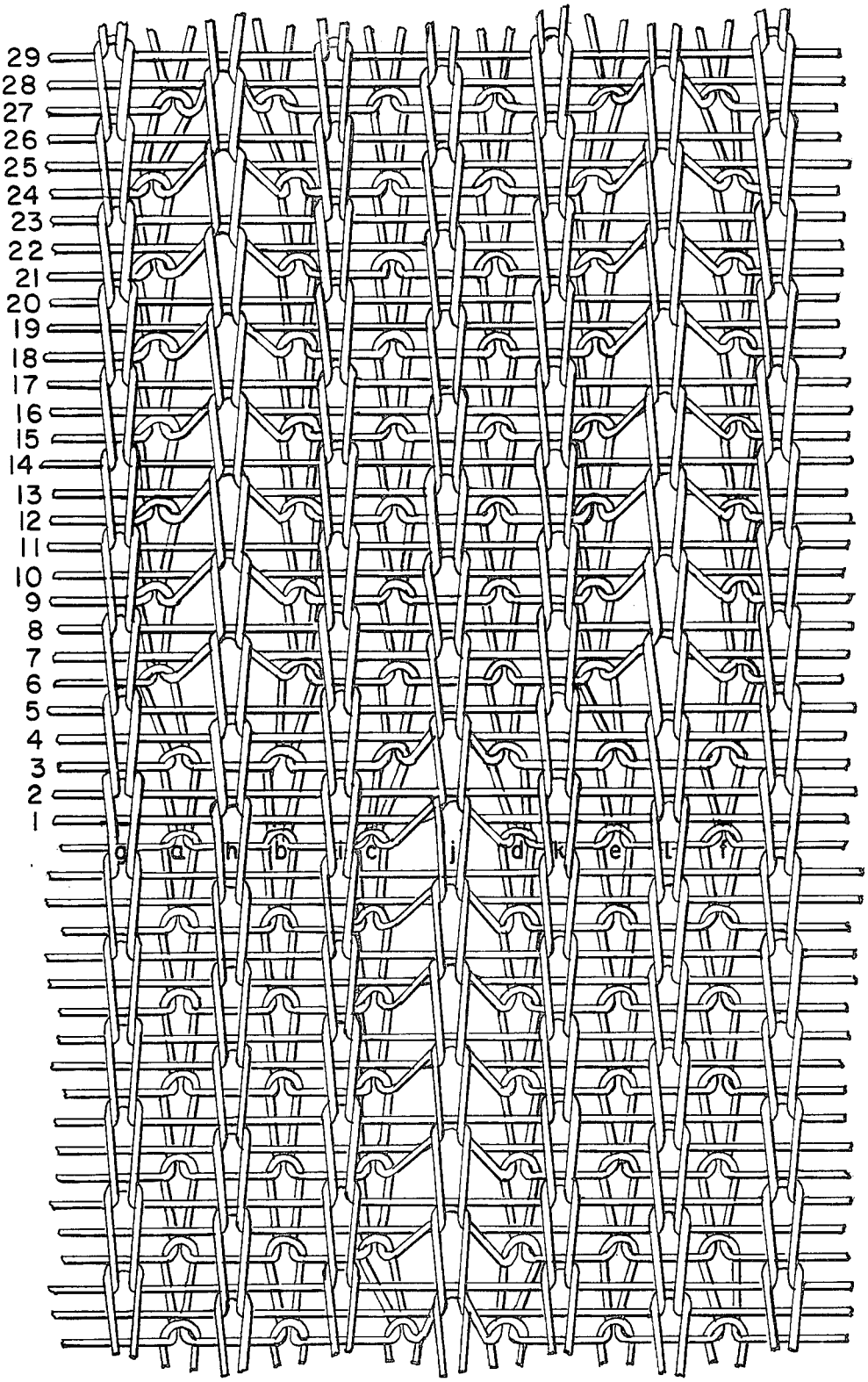
FIG. 4 is a schematic representation of the double knit fabric and is a composite of FIGS. 1 and 2.

In order to dispose the abovementioned ordinary net structure uniformly, the abovementioned knitting method is repeated using the yarns 1 to 24. Next, from yarns 25 to 48, interlocking of the rear yarns with the front yarns is moved by two wales so that the loop between the wales c and d is interlocked with the loop j. This procedure is repeated to the front and back and to the right and left, thereby forming a knitted fabric. FIG. 4 shows the interlocking of the loop between wales a and b to the front loop h and the loop between wales e and f to the front loop 1. This figure also shows that after yarns 1–24, the interlocking of the rear yarns with the front yarns is moved by two wales so that the loop between wales c and d is interlocked with loop j.

In accordance with the present invention, the plain stitch is made using the synthetic fiber yarns such as processed polyester yarns and the like to obtain a front fabric having good abrasion resistance, flat appearance, excellent dyeability and the like, while a natural fiber yarns such as cotton is used for the rear fabric. Furthermore, a double-knit structure having a bag-like gap is formed between the front fabric consisting of the loops i, j, k and the rear fabric consisting of loops b, c, d, e. Consequently, the resulting fabric increases in its thickness. In addition, because of the net structure, air-retainability is increased when the fabric is worn, and properties such as hygroscopicity, heat-retainability, air-permeability, etc., are further enchanced. Hence, a part or the whole of the knitted fabric of the present invention may advantageously be sewn into various sport wear such as shirts and trousers for athletic purposes.

What is claimed is:

1. A double knit fabric having a front surface comprising courses of plain knit stitches formed from a synthetic fiber yarn such as polyester and a rear surface comprising courses of plain knit stitches formed from a natural fiber yarn such as cotton, or a blended yarn wherein each of the front and rear surface courses are interlocked with one another by the engagement of a plurality of loops between a first pair of rear surface wales to a first series of loops of a front surface wale with this interlocking occurring for a first series of courses with a plurality of non interlocked rear wales occurring between adjacent first wale pairs and wherein said wale pairs are separated by an interlocking of the loops of a second rear wale pair to a second series of front surface loops in a second series of courses adjacent to said first course series.

* * * * *